US009839987B2

(12) United States Patent
Ren et al.

(10) Patent No.: US 9,839,987 B2
(45) Date of Patent: Dec. 12, 2017

(54) DOUBLE-DISC STRAIGHT GROOVE CYLINDRICAL-COMPONENT SURFACE GRINDING DISC

(71) Applicant: TIANJIN UNIVERSITY, Tianjin (CN)

(72) Inventors: Chengzu Ren, Tianjin (CN); Xiaofan Deng, Tianjin (CN); Yinglun He, Tianjin (CN); Guang Chen, Tianjin (CN); Xinmin Jin, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 15/619,443

(22) Filed: Jun. 10, 2017

(65) Prior Publication Data

US 2017/0274499 A1 Sep. 28, 2017

Related U.S. Application Data

(63) Continuation of application No. PCT/CN2015/095394, filed on Nov. 24, 2015.

(30) Foreign Application Priority Data

Dec. 16, 2014 (CN) ..... 2014 1 0783965

(51) Int. Cl.
*B24B 37/04* (2012.01)
*B24B 37/08* (2012.01)
(Continued)

(52) U.S. Cl.
CPC ..... *B24B 37/26* (2013.01); *B24B 37/02* (2013.01); *B24B 37/04* (2013.01); *B24B 37/08* (2013.01); *B24B 37/16* (2013.01)

(58) Field of Classification Search
CPC ..... B24B 37/02; B24B 37/04; B24B 37/042; B24B 37/08; B24B 37/16; B24B 37/26
(Continued)

(56) References Cited

U.S. PATENT DOCUMENTS 2,423,118 A * 7/1947 Ramsay ..... B24B 37/08 125/901
2008/0233840 A1* 9/2008 Pietsch ..... B24B 37/08 451/41
(Continued)

FOREIGN PATENT DOCUMENTS

CN 103537981 A 1/2014
CN 104128877 A 5/2014
(Continued)

*Primary Examiner* — Eileen Morgan
(74) *Attorney, Agent, or Firm* — Wayne & King LLC

(57) ABSTRACT

A double-disc straight groove cylindrical-component surface grinding disc, includes a first grinding disc and a second grinding disc, rotating relative to each other; the the first grinding disc's working face is planar; the second grinding disc's surface, opposite the first grinding disc, includes a set of radial straight grooves, with groove faces of the straight grooves are the working face of the second grinding disc; the cross-sectional outline of the working face of the second grinding disc is arcuate or V-shaped or is a V-shape having an arc; during grinding, a workpiece spins inside the straight grooves, while under the effect of an advancing apparatus, the workpiece slides in translational motion along the straight grooves. The described grinding disc device has high-volume production capabilities, and the shape accuracy and size consistency of the cylindrical roller's cylindrical surface and the efficiency in machining are improved, and machining cost is reduced.

3 Claims, 6 Drawing Sheets

(51) Int. Cl.
*B24B 37/16* (2012.01)
*B24B 37/26* (2012.01)
*B24B 37/02* (2012.01)

(58) Field of Classification Search
USPC ..... 451/261, 262
See application file for complete search history.

(56) References Cited

U.S. PATENT DOCUMENTS

2009/0042487 A1* 2/2009 Tokura ..... B24B 49/16
451/41
2014/0378035 A1* 12/2014 Noro ..... B24B 37/26
451/528

FOREIGN PATENT DOCUMENTS

| | | | |
|---|---|---|---|
| CN | 104493684 | * | 4/2015 |
| CN | 104493684 | A | 4/2015 |
| CN | 104493689 | A | 4/2015 |
| CN | 204366696 | U | 6/2015 |
| CN | 204700743 | U | 10/2015 |
| JP | 2001025948 | A | 1/2001 |
| JP | 2002355742 | A | 12/2002 |

* cited by examiner

DOUBLE-DISC STRAIGHT GROOVE CYLINDRICAL-COMPONENT SURFACE GRINDING DISC

CROSS-REFERENCE TO RELATED APPLICATIONS

This application is a continuation of International Patent Application No. PCT/CN2015/095394 with a filing date of Nov. 24, 2015, designating the United States, now pending, and further claims priority to Chinese Patent Application No. 2014107839652 with a filing date of Dec. 16, 2014. The content of the aforementioned application, including any intervening amendments thereto, are incorporated herein by reference.

TECHNICAL FIELD

The present invention relates to a technical field of precision machining excircle surfaces of high precision cylindrical components, and more particularly to an excircle surface grinding device for a cylindrical-component and a method thereof.

BACKGROUND OF THE PRESENT INVENTION

Cylindrical roller bearings are widely used in various types of rotating machines. As a cylindrical roller is an important component of the cylindrical roller bearing, excircle surfaces machining precision of the cylindrical roller directly impacts the performance of the cylindrical roller bearings. Main methods of precision machining on excircle surfaces of cylindrical components include super-finishing methods and double-disc planetary grinding methods.

The super-finishing method is a micro finishing method, which can achieve micro cutting effects, by using a fine-grained whetstone as a grinding tool, such that the whetstone may apply load on a workpiece and perform a low-speed axial movement as well as a micro-reciprocating vibration relative to the workpiece. At present, a mostly used method of precision machining on excircle surfaces of the cylindrical roller is a through-feed centerless super-finishing method, which involves devices consisting of two guide rollers and a super-fine head assembled with a whetstone, the guide roller supporting and driving the workpiece to perform a low-speed spiral movement, the super-fine head applying a comparative low pressure to press the whetstone to the workpiece, the whetstone achieving a surface contact with the workpiece, and at the same time the whetstone performing a high-frequency vibration along an axial direction. During the process of the through-feed centerless super-finishing method, cylindrical rollers of successively penetrate processing areas and subject to be superfinished by the whetstone, and until all the cylindrical rollers have passed through the processing area for several times, a certain super-finishing process (rough finishing process, Fine finishing process, or super finishing process) ends. The through-feed centerless super-finishing method can improve the surface roughness of the workpiece (the through-feed centerless super-finishing method usually may obtain an accuracy up to Ra0.025 μm), remove a surface degenerating layer formed by a prior process, and improve a roundness of the workpiece. Except for wear conditions of the whetstone and the super finishing roller, as well as differences of the cylindrical roller itself, each cylindrical roller share common super finishing conditions and parameters.

However, due to the limitations of processing principles, the super-finishing method involves following technical defects. In one aspect, variations of wear conditions of the whetstone and the super finishing roller are unfavorable for improving cylindrical surface size accuracy and shape accuracy of the cylindrical roller; in the other aspect, as in the through-feed centerless super-finishing method, only a limited number of cylindrical rollers are processed at the same time, and material removal amounts therein are almost independent of the difference between diameter thereof with that of the other cylindrical rollers of the same batch, so the through-feed centerless super-finishing method cannot obviously reduce the diameter difference of the cylindrical rollers. The above two aspects may lead to a slow improvement on excircle surface finishing precisions (shape accuracy and dimensional consistency) of the workpiece, a long processing cycle, and a high cost.

The main structure of a double-disc planetary cylindrical-component grinding device includes an upper grinding disc, a lower grinding disc, a planetary wheel retainer, an outer ring gear and an inner ring gear. The upper grinding disc and the lower grinding disc are coaxially arranged and respectively rotate independently, the upper plate grinding disc functioning to apply pressure. The planetary wheel retainer is placed between the inner ring gear and the outer ring gear, and a cylindrical roller is placed in a hole of the retainer, with the hole radically distributed on a surface of the retainer. During a grinding process, the retainer performs a revolution around a center of the grinding disc as well as a self rotation, under the effect of the upper and lower discs as well as the retainer, while the cylindrical roller performs a revolution around a center of the retainer and at the same time a rotation around an axis itself, thus involving a complicated spatial motion. A micro material removal is achieved under an effect of grinding solutions between the upper and lower grinding discs. Double-disc planetary cylindrical components grinding device can achieve an excircle surface of cylindrical workpiece with a high precision, for example, for a workpiece with a length of 30~40 mm, after a super-finishing of a double-disc grinding machine, a roundness error of less than 0.001 mm may be achieved, a vertical section diameter consistency may be less than 0.002 mm, and a surface roughness is less than Ra0.025 μm. However, the double-disc grinding machine can only be used for excircle super-finishing on small batch (dozens to hundreds) of cylindrical workpiece. For the large volume of bearing roller demand, it is difficult for the double-disc planetary grinding method to meet.

It can be seen that there is an inherent lack of processing precision when the excircle surface of the cylindrical workpiece is processed by the through-feed centerless super-finishing method, while the double-disc grinding method cannot meet the demand of a mass production, and thus there is an urgent need for a super-finishing device for excircle surface of the cylindrical component, which may achieve a high processing precision and a mass production, so as to meet requirements of the high precision cylindrical roller bearing on the processing precision of excircle surfaces of the cylindrical rollers, as well as the demand of production scales.

SUMMARY OF PRESENT INVENTION

Aiming at the problems in the prior art, a cylindrical-component grinding device and a grinding method using the same are provided in the present invention. The invention has the ability to meet demands of a mass production, to achieve a large removal of materials at a high position, and a small removal of that at a low position, and to realize a large material removal on the cylindrical surface of the cylindrical roller with a large diameter, and a small material removal on the cylindrical surface of the cylindrical roller with a small diameter, so as to improve the shape accuracy and dimensional consistency of cylindrical surfaces of the cylindrical roller, to enhance surface processing efficiencies of the cylindrical components (i.e., the cylindrical roller), and to reduce processing costs.

In order to solve the above technical problems, a double-disc straight groove cylindrical-component surface grinding disc is provided in the invention, including a first grinding disc and, a second grinding disc, the second grinding disc and the first grinding disc rotating relative to each other, the second grinding disc having, a rotation axis OO' relative to the first grinding disc. A surface of the first grinding disc, opposite to the second grinding disc is planar, which is a working surface of the first grinding disc, and a plurality of radial straight grooves are provided on a surface of the second grinding disc opposite to the first grinding disc, the straight groove having a groove surface functioning as a working face of the second grinding disc, the working face of the second grinding disc having a cross-section profile in an arc shape or a V shape or a V shape with an arc; during grinding process, a processing workpiece is arranged in the straight groove along a groove extending direction, and meanwhile, an outer cylindrical surface of the processing workpiece contacts with the working face of the second grinding disc; the straight groove has a reference plane, a plane that passes through an axis l of the processing workpiece arranged in the straight groove, and is perpendicular to the working face of the first grinding disc; there is an angle θ between a normal plane at a contacting point or a midpoint of a contacting arc between the processing workpiece and the straight groove, and the reference plane of the straight groove, the angle θ ranging in 30~60°; one end of the straight groove close to a center of the second grinding disc is a propulsion port, and the other end of the straight groove is a discharge outlet; an eccentric distance e exists between the reference plane of the straight groove and the rotation axis OO', and the value of e is larger than or equal to zero, and smaller than a distance from the rotation axis OO' to the discharge outlet of the straight groove; when the value of the eccentric distance e is zero, the straight groove is arranged in a radial arrangement; and the second grinding disc has a central position with a mounting portion of the workpiece advancing apparatus provided thereon; under a condition of a grinding pressure and grinding lubrication, a friction coefficient between materials of the first grinding disc's working face and materials of the processing workpiece is f1, a friction coefficient between materials of the second grinding disc's working face and materials of the processing workpiece is f2, and f1>f2, so as to, ensure the processing workpiece to achieve spinning in the grinding process.

Compared with the prior art, the invention has the advantages as follows.

By virtue of arranging the double-disc straight groove cylindrical-component surface grinding disc of the invention into a cylindrical-component grinding device, plenty of processing workpieces distributed in the plurality of straight grooves at the same time can be simultaneously engaged in the grinding process, and the cylindrical-component grinding device is generally provided with a mixing apparatus, so the combination of the processing workpieces at the same time is highly random, the work load endured by the cylindrical roller with a larger diameter is greater than that of the cylindrical roller with a smaller diameter, and the work load endured by a processing face of the workpiece at a high position is larger than that of the processing face of the workpiece at a low position, thus facilitating a large material removal on cylindrical surfaces of the cylindrical roller with a larger diameter, a small material removal on cylindrical surfaces of the cylindrical roller with a smaller diameter, as well as a large material removal at a high processing face, and a small material removal on a low processing face, further to improve the consistency of cylindrical surfaces of the cylindrical roller. Because the large number of workpieces involved in processing at the same me and feature that a large material removal is involved on cylindrical surfaces of the cylindrical roller with a larger diameter, and a large material removal at a high position, all contribute to the improvement of processing efficiency on cylindrical surface of the cylindrical roller, thus an ability of a mass production is achieved, an excellent dimensional consistency of the workpiece, and a high shape accuracy and a high processing efficiency of cylindrical surface of the cylindrical roller, are involved, as well as a low processing cost.

DESCRIPTION OF THE DRAWINGS

FIG. 4(*a*) (*b*) and (*c*) are cross, section views of a workpiece to be processed in the grinding disc apparatus, wherein: FIG. 4(*a*) illustrates a V-shaped cross-section profile of a working face of the straight groove of the second grinding disc; FIG. 4(*b*) illustrates an arc-shaped cross-section profile of the working face of the straight groove of the second grinding disc; and FIG. 4(*c*) illustrates a cross-section profile of a working face the second grinding disc in a V shape with an arc;

Figure 1:
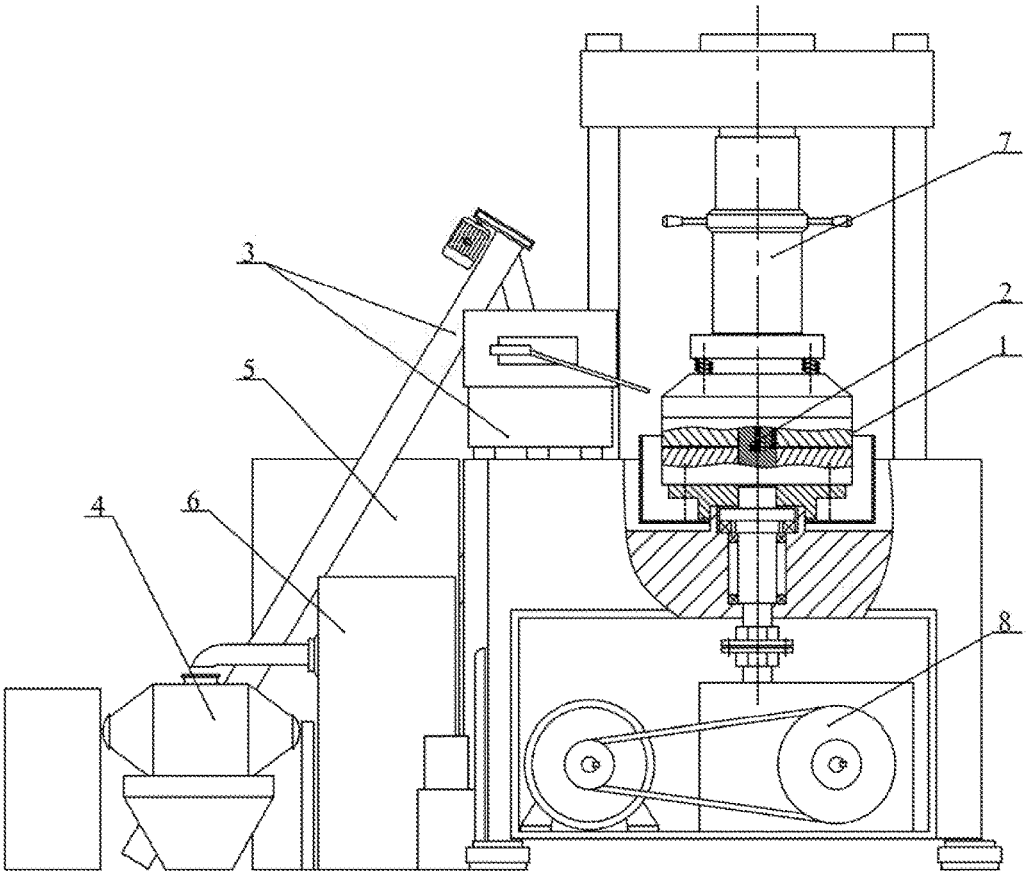
FIG. 1 is a schematic view of an excircle surface superfinishing device for a double-disc straight groove cylindrical component.

In the figures;

reference sign 1 indicates a grinding disc apparatus; reference sign 2 indicates a workpiece advancing apparatus;

reference sign 3 indicates a workpiece conveying apparatus; reference sign 4 indicates a workpiece mixing apparatus;

reference sign 5 indicates a workpiece and grinding fluid separation apparatus; reference sign 6 indicates a workpiece cleaning apparatus;

reference sign 7 indicates a loading apparatus; reference sign 8 indicates a power system;

reference sign 9 indicates a processing workpiece; reference sign 11 indicates a first grinding disc;

reference sign 111 indicates the first grinding disc's working face;

reference sign 12 indicates a second grinding disc;

reference sign OO' indicates a rotation axis of the second grinding disc relative to the first grinding disc; reference sign 121 indicates a straight groove;

reference sign 1211 indicates the second grinding disc's working face; reference sign 1212 indicates art escrape at the bottom of the straight groove of the second grinding disc;

Reference sign l indicates the axis of the processing workpiece in the straight groove;

Reference sign $\Delta\omega$ indicates the relative rotational speed of the second grinding disc and the first grinding disc;

reference sign $\omega_1$ indicates the spin angular velocity of processing workpiece under the processing;

reference sign $\alpha$ indicates a plane passing through the axis l and perpendicular to the working face of the first grinding disc;

reference sign $\beta$ indicates a normal plane at an unique contacting point or a midpoint A of a contacting arc between the processing workpiece and the straight groove;

reference sign $\theta$ indicates an angle between plane $\alpha$ and plane $\beta$;

reference sign e indicates an eccentric distance from the plane $\alpha$ to the second grinding disc's rotational axis OO' relative to the first grinding disc;

reference sign r indicates an excircle radius of the processing workpiece.

DETAILED DESCRIPTION OF PREFERRED EMBODIMENTS

The technical solution of the present invention will now be described in further detail with reference to the accompanying drawings and specific examples.

Figure 2:
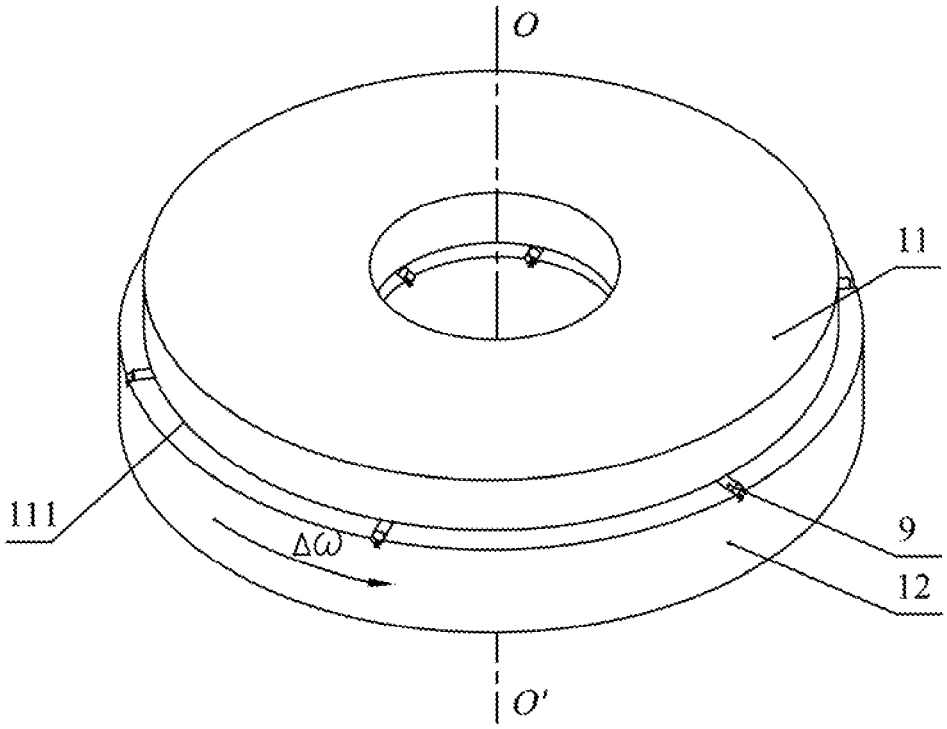
FIG. 2 is a schematic view of a grinding disc apparatus.
Figure 3:
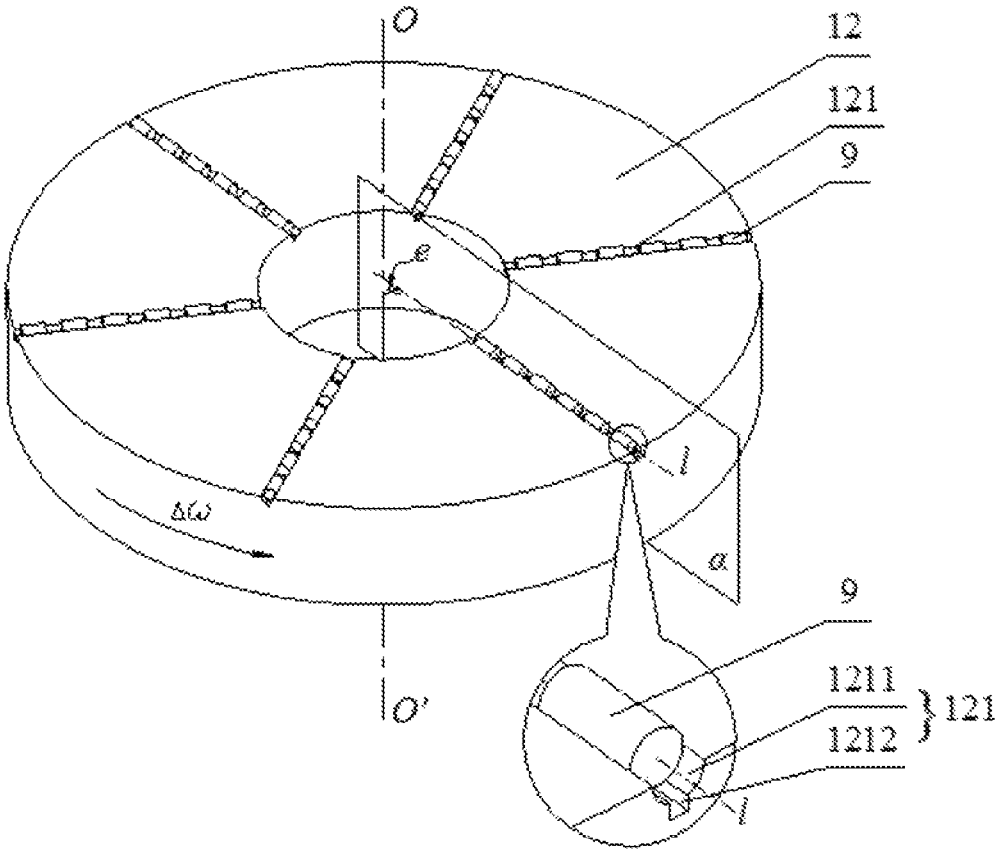
FIG. 3 is a schematic view of second grinding disc having a straight groove.
Figure 4A:
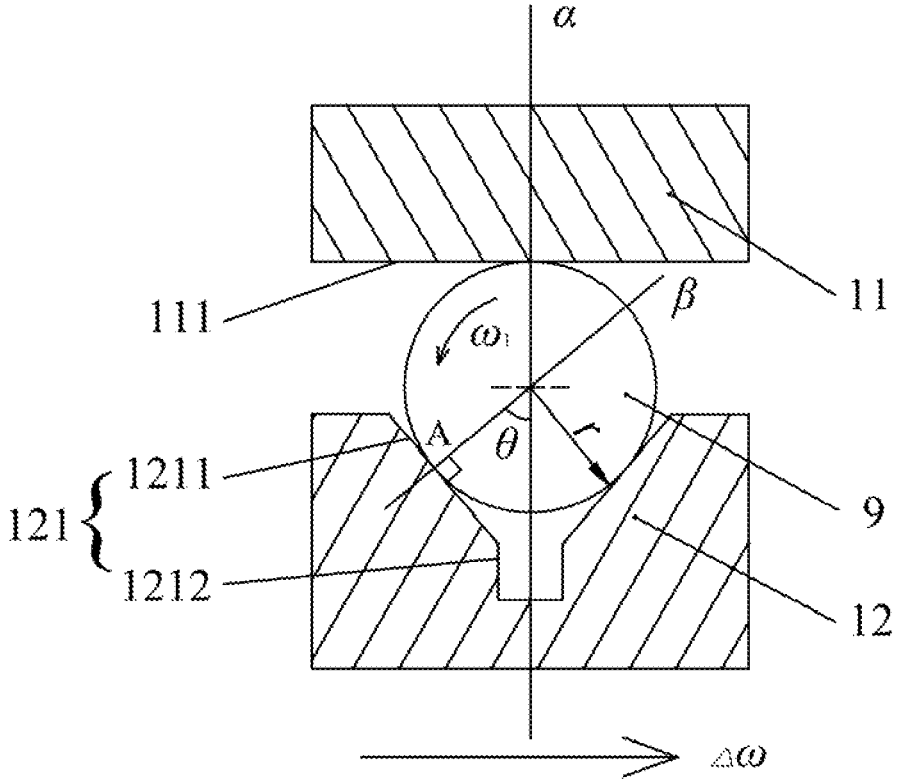
Figure 4B:
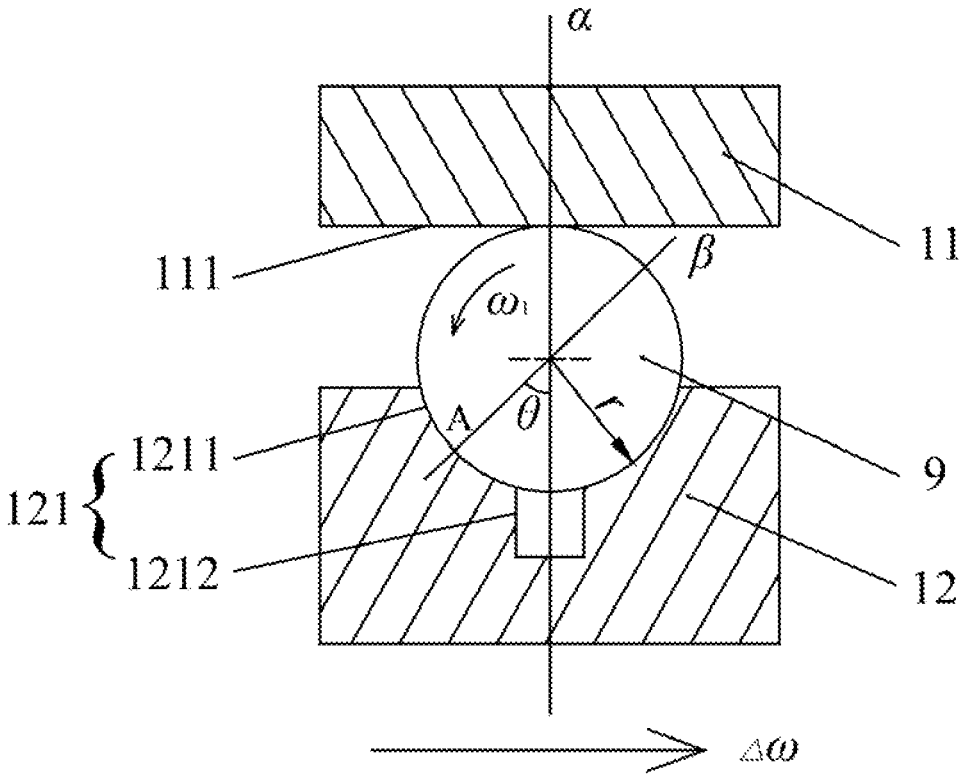
Figure 4C:
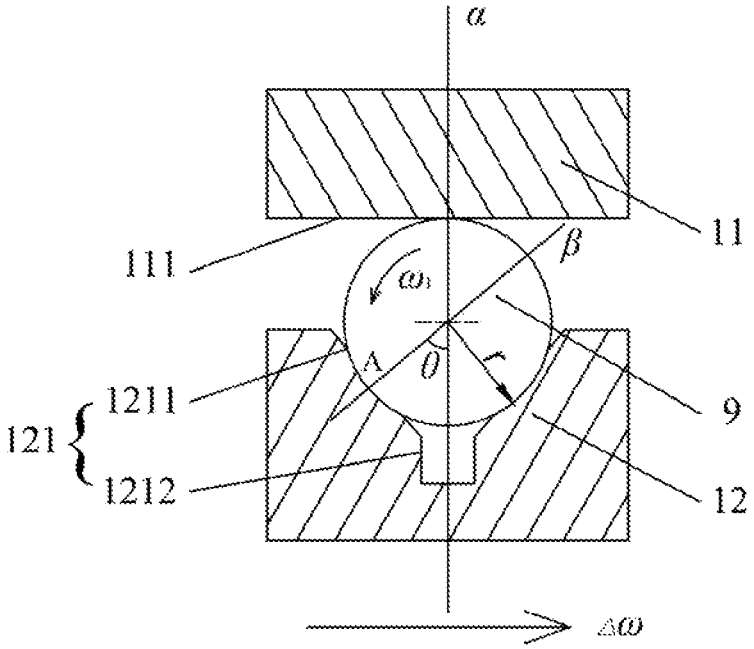

As shown in FIG. 2, a double-disc straight groove cylindrical-component surface grinding disc of the invention, includes a first grinding disc 11 and a second grinding disc 12, and the second grinding disc 12 and the first grinding disc 11 rotate relative to each other. The second grinding disc 12 has a rotation axis OO' relative to the first grinding disc 11, a surface of the first grinding disc 11, opposite to the second grinding disc 12, is planar, which is a working surface 111 of the first grinding disc 11. As shown in FIG. 3, a plurality of radial straight grooves 121 are provided on a surface of the second grinding disc 12 opposite to the first grinding disc 11, and a groove surface of the straight groove 121 is a working surface 1211 of the second grinding disc 12. As shown in FIG. 4, the working face 1211 of the second grinding disc 12 has a cross-section profile in an arc shape or a V shape or a V shape with an arc. Herein, the cross-section profile of the working face 1211 of the second grinding disc 12 shown in FIG. 4-(*a*) is V-shaped, the cross-section profile of the work surface 1211 of the second grinding disc 12 shown in FIG. 4-(*b*) is in an arc shape, and the cross-section profile of the working face 1211 of the second grinding disc 12 as shown in FIG. 4-(*c*) is a V shape with an arc. The bottom of the straight groove is provided with an escrape 1212. Processing workpieces 9 are laterally disposed on the straight groove 121, to be processed in a grinding working area consisting of the working face 111 of the first grinding disc 11 and the working face 1211 of the second grinding disc 12. Under load conditions and lubrication conditions of the grinding fluid, the friction pair formed by the material of the working face 111 of the first grinding disc 11 and the material of the processing workpiece 9 has a friction coefficient f1 larger than a friction coefficient f2 of the friction pair formed by the material of the working face 1211 of the second grinding disc 12 and the material of the processing workpiece 9 under the same conditions.

During grinding process, the processing workpiece 9 is arranged in the straight groove 121 along a groove extending direction, meanwhile, an outer cylindrical surface of the processing workpiece 9 contacts with the working face 1211 of the second grinding disc 12, and the working face 1211 of the straight groove 121 locates the position of the excircle surface of the workpiece 9. The straight groove 121 has a reference plane $\alpha$, a plane that passes through an axis l of the processing workpiece arranged in the straight groove, and is perpendicular to the working face 111 of the first grinding disc 11. There is an angle $\theta$ between a normal plane $\beta$ at a contacting point or a midpoint A of a contacting arc between the processing workpiece 9 and the straight groove 121, and the reference plane of the straight groove 121. The angle $\theta$ ranges in 30~60°. One end of the straight groove 121 close to the center of the second grinding disc 12 is a propulsion port of the processing workpiece, and the other end of the straight groove 121 is a discharge outlet An eccentric distance e exists between the reference plane $\alpha$ of the straight groove 121 and the second grinding disc's rotation axis OO' relative to the first grinding disc. The value of e is larger than or equal to zero, and smaller than a distance from the rotation axis OO' to the discharge outlet of the straight groove 121. When the value of the eccentric distance e is zero, the straight groove 121 is actually arranged in a radial arrangement, and the second grinding disc 12 has a mounting portion of the workpiece advancing apparatus 2, provided at a central position thereof.

Under the conditions of the grinding pressure and grinding lubrication, the friction coefficient between the material of the first grinding discs working face 111 and the material of the processing workpiece is f1, and the friction coefficient between the material of the second grinding disc's working face 1211 and the material of the processing workpiece is f2, and f1>f2, so as to ensure that the processing workpiece may achieve spinning in the grinding process.

As shown in FIG. 1, a cylindrical-component grinding device with the double-disc straight groove cylindrical-component surface grinding disc of the invention arranged therein, includes a loading apparatus 7, a power system 8, and a workpiece advancing apparatus 2, a grinding, disc apparatus 1, a workpiece and grinding fluid separating apparatus 5, a workpiece cleaning apparatus 6 and workpiece mixing apparatus 4, the later five apparatuses connecting with a workpiece conveying apparatus 3 in sequence. The loading apparatus 7 is configured for material loading of the grinding disc apparatus 1, and the power system 8 is configured for driving the grinding disc apparatus 1. Herein, the workpiece conveying apparatus 3 may employ a common vibration feeding mechanism and a screw feeding mechanism on the market, which function to realize a continuous feeding of the processing workpiece 9. The workpiece mixing apparatus 4 according to the present invention adopts a common cylindrical workpiece mixing mechanism on the market, for achieving disordering the sequence of the workplace and improving the randomness of the processing. The workpiece and grinding fluid separating apparatus 5 of the present invention is provided with a precipitation tank, a grinding fluid delivery pipe and a grinding fluid separation apparatus, for conveying the grinding fluid to the device, collecting the used grinding fluid, and for separating the grinding debris and grinding fluid after precipitation and filtration, thus to achieve a recycling of grinding fluid. The workpiece cleaning apparatus 6 of the present invention employs a common workpiece cleaning apparatus on the market, for cleaning the primarily grinded workplace with a cleaning liquid and for recovering the cleaning liquid. In order to prevent environment pollution, the wastewater produced by cleaning of rollers firstly flows into the precipitation tank to precipitate through the pipe, and precipitated waste water enters the grinding fluid separation apparatus for a centrifugal separation and filtration. Separated cleaning liquid then returns to the roller cleaning apparatus and gets a reuse.

To realize grinding on cylindrical components by virtue of the cylindrical-component grinding device of the present invention, following steps are included.

Step 1 is workpiece feeding. Herein, the workpiece conveying apparatus 3 feeds the processing workplace into a material storage hopper of the workplace advancing apparatus 2, and under the drive of an intermittent reciprocating mechanism, a push rod pushes the processing workplace 9 in the material storage hopper from the bottom of the material storage hopper to the straight groove 121, until all the straight grooves are fulfilled with the processing workplace 9.

Step 2 is grinding processing. Herein, the loading apparatus 7 provides loading for the grinding disc apparatus 1, the workpiece 9 contacts with the first grinding disc's working face 111 and the second grinding disc's working face 1211; the power system 8 drives the grinding disc apparatus 1, the second grinding disc 12 rotates relative to the first grinding disc 11, the processing workpiece 9 is processed in the grinding working area formed by the working face 111 of the first grinding disc 11 and the working face 1211 of the second grinding disc 12. Under the conditions of the grinding pressure and grinding lubrication, the friction coefficient f1 between the material of the first grinding disc's working face 111 and the material of the processing workpiece is larger than the friction coefficient f2 between the material of the second grinding disc's working face 1211 and the material of the processing workpiece, so with the joint cooperation of the first grinding disc 11 and the second grinding disc 12, the processing workpiece may spinning along its axis, and at the same time, the advancing apparatus 2 keeps pushing the processing workpiece 9 into the straight groove 121. Pushed by following processing workpieces 9, the processing workpiece 9 in the straight groove 121 performs translational slide motion from the propulsion port of the straight groove 121 towards the discharge outlet. During the above-described motion, the contacting region between the working face of the grinding disk apparatus 1 and an outer cylindrical surface of the processing workpiece 9, under the effect of free grinding particles in the grinding fluid, may realize a micro material removal of the processing workpiece 9, until the processing workpiece 9 has been discharged from the discharge outlet of the straight groove 121.

During the grinding process, plenty of processing workpieces 9 distributed in the plurality of straight grooves 121 at the same time are simultaneously engaged in the grinding process, and the combination of the processing workpieces 9 at the same time is highly random, the load endured by the processing workpiece 9 with a larger diameter is greater than that of the processing workpiece 9 with a smaller diameter, thus facilitating a large material removal on excircle surfaces of the processing workpiece 9 in a larger diameter, as well as small material removal on excircle surfaces of the processing workpiece 9 in a smaller diameter, further to improve the processing efficiency, and dimensional accuracy and consistency of encircle surfaces of the processing workpiece 9.

Step 3 is workpiece cleaning. Herein, the workpiece and grinding fluid separating apparatus 5 separates the workpiece graded in step 2 from the grinding fluid, and after filtration and precipitation, the grinding fluid is then in reuse. After the workpiece is cleaned by the workpiece cleaning apparatus 6, the process goes on to step 4.

Step 4 is that after the workpieces have been disordered by the workpiece mixing apparatus 4, the process goes back to step 1;

After a period of continuous cycle grinding processing, a sampling inspection of the workpiece is made, and if the result meets the process requirements, the grinding processing ends, or otherwise, the grinding processing continues.

By virtue of the present invention, it is achieved that plenty of the processing workpieces 9 distributed in the straight groove 121 at the same time are engaged in the grinding process, and the combination of the processing workpieces 9 at the same time is highly random, the load endured by the processing workpiece 9 with a larger diameter is greater than that of the processing workpiece 9 with a smaller diameter, thus facilitating a large material removal on cylindrical surfaces of the processing workpiece 9 in a larger diameter, as well as a small material removal on cylindrical surfaces of the processing workpiece 9 in a smaller diameter, further to improve the dimensional consistency of cylindrical surfaces of the processing workpiece 9. A large removal of the material at a high position and a larger material removal of the processing workpiece 9 in a larger diameter, contribute to the improvement of processing efficiency on cylindrical surface of the processing workpiece 9.

Though the invention has been described above with reference to the accompanying drawings, the invention shall not be limited to the specific embodiments described above, and the specific embodiments described above are merely illustrative and not restrictive, and for one of ordinary skill in the art, under the inspiration of the present invention, many modifications may be made without departing from the spirit of the invention, which shall fall into the protection scope of the present invention.

We claim:

1. A double-disc straight groove cylindrical-component surface grinding disc, comprising a first grinding disc (11) and a second grinding disc (12); wherein:

the second grinding disc (12) and the first grinding disc (11) rotates relative to each other, the second grinding disc (12) having a rotation, axis OO' relative to the first grinding disc (11); a surface of the first grinding disc 11, opposite to the second grinding disc (12) is planar, which is a working surface (111) of the first grinding disc (11); and a plurality of radial straight grooves (121) are provided on a surface of the second grinding disc (12) opposite to the first grinding disc (11), the straight groove (121) having a groove surface as a working face (1211) of the second grinding disc (12), the working face (1211) of the second grinding disc (12) having a cross-section profile in an arc shape or a V shape or a V shape with an arc; during grinding process, a processing workpiece (9) is arranged in the straight, groove (121) along a groove extending direction, and meanwhile, an outer cylindrical surface of the processing workpiece (9) contacts with the working face (1211) of the second grinding disc (12);

the straight groove (121) has a reference plane, a plane that passes through an axis l of the processing workpiece arranged in the straight groove, and is perpendicular to the working face (111) of the first grinding disc (11); there is an angle θ between a normal plane at a contacting point or a midpoint of a contacting arc between the processing workpiece (9) and the straight groove (121), and the reference plane of the straight groove (121), the angle θ ranging in 30~60 °;

one end of the straight groove (121) close to a center of the second grinding disc (12) is a propulsion port, and the other end of the straight groove (121) is a discharge outlet; an eccentric distance e exists between the reference plane of the straight groove (121) and the rotation axis OO', and the value of e is larger than or equal to zero, and smaller than a distance from the rotation axis OO' to the discharge outlet of the straight groove (121); when the value of the eccentric distance e is zero, the straight groove (121) is arranged in a radial arrangement; and the second grinding disc (12) has a central position with a mounting portion of the workpiece advancing, apparatus (2) provided thereon;

under a condition of a grinding pressure and grinding lubrication, a friction coefficient between materials of the first grinding disc's working face (111) and materials of the processing workpiece is f1, a friction coefficient between materials of the second grinding disc's working face (1211) and materials, of the processing workpiece is f2, and f1>f2, so as to ensure the processing workpiece to achieve spinning in the grinding process.

2. The double-disc straight groove cylindrical-component surface grinding disc as described in claim 1, wherein, the second grinding disc 12 has a central position provided with a mounting portion of the workpiece advancing apparatus.

3. The double-disc straight groove cylindrical-component surface grinding disc as described in claim 1, wherein, a grinding disc loading apparatus and a power system are included.

* * * * *